US006299750B1

(12) United States Patent
Pilgenröder et al.

(10) Patent No.: US 6,299,750 B1
(45) Date of Patent: Oct. 9, 2001

(54) COATING METHOD FOR ELONGATED METAL BLANKS

(76) Inventors: Horst Pilgenröder, Marpe 19, D-42287 Wuppertal; Vincenzo Cavallaro, Neukuchhausen 30, D-42349 Wuppertal, both of (DE)

( * ) Notice: Subject to any disclaimer, the term of this patent is extended or adjusted under 35 U.S.C. 154(b) by 0 days.

(21) Appl. No.: 09/402,872

(22) PCT Filed: Apr. 7, 1998

(86) PCT No.: PCT/EP98/02000

§ 371 Date: Jan. 3, 2000

§ 102(e) Date: Jan. 3, 2000

(87) PCT Pub. No.: WO98/46806

PCT Pub. Date: Oct. 22, 1998

(30) Foreign Application Priority Data

Apr. 11, 1997 (DE) ..... 197 15 208

(51) Int. Cl.[7] ..... C25D 17/16; C25D 15/00; C25D 5/48; C25D 5/52

(52) U.S. Cl. ..... 205/143; 205/109; 205/110; 205/220; 205/222

(58) Field of Search ..... 205/109, 110, 205/143, 220, 222

(56) References Cited

U.S. PATENT DOCUMENTS 3,620,953 * 11/1971 Inoue ..... 204/202
5,259,280 * 11/1993 Hoy ..... 81/436
5,702,763 12/1997 Feldstein ..... 427/241

FOREIGN PATENT DOCUMENTS 2855054 7/1979 (DE) .
2920593 1/1980 (DE) .
3323240 1/1985 (DE) .

OTHER PUBLICATIONS

Schafer, "Entgraten Theorie, Verfahren, Anlagen", (1975) pp. 93–98, no month available*

"Produktionstechnik Heute" Published by Prof. H.T. Warnecke, vol. 14, Entgraten, Theorie, Verfahrnen, Anlagen by F.Schafer, pp. 93–98 (1975) *No Month Available.

* cited by examiner

*Primary Examiner*—Edna Wong
(74) *Attorney, Agent, or Firm*—Martin A. Farber

(57) ABSTRACT

A method based on superfinishing for coating elongated metal blanks. The blanks have at least two axially aligned portions with varying cross-sections, wherein particles of a hard substance protruding from the surface of the coating are embedded into a metal lining in a chemical electroplating bath on the surface of a first portion provided with indentations or the like. The exposed surfaces of a second portion remain substantially devoid of hard surface particles, by a plurality of blanks being freely circulated in a rotating drum in a dispersion which is suspended in the electroplating wherein the hard substance particles adhering to the exposed surfaces are removed again by rubbing the blanks against each other.

23 Claims, 3 Drawing Sheets

Fig. 1
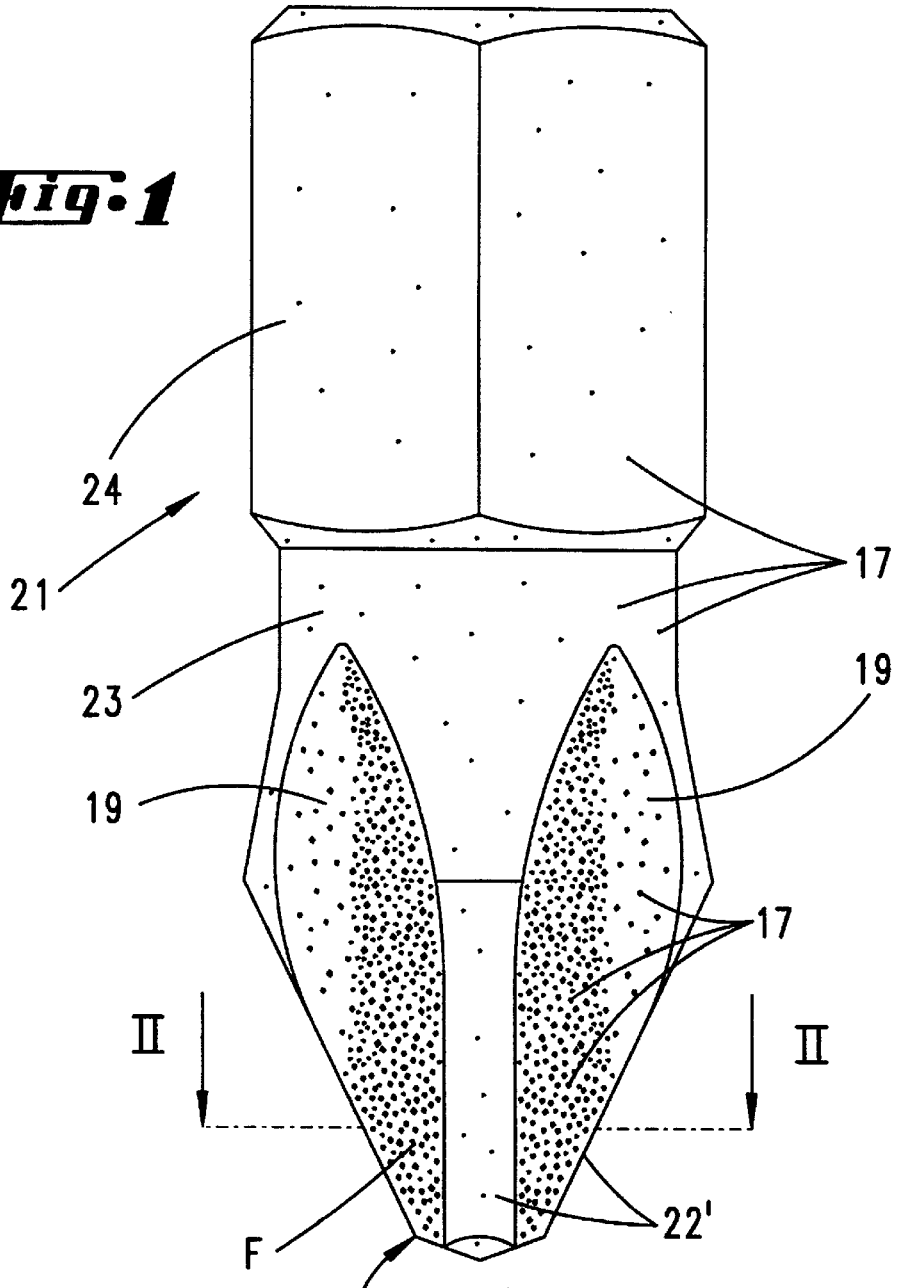
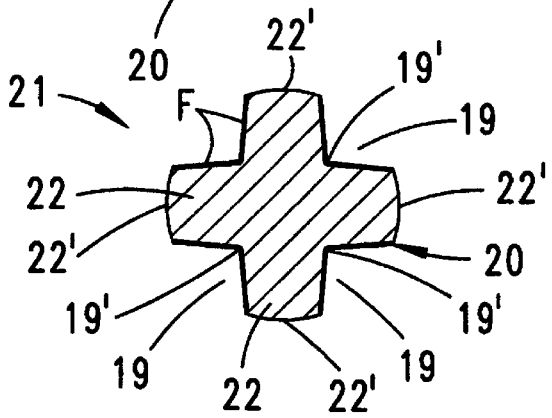
Fig. 2

COATING METHOD FOR ELONGATED METAL BLANKS

FIELD AND BACKGROUND OF THE INVENTION

The invention relates to a method for coating elongated metal blanks.

In the series of books "Produktionstechnik heute" [Production Engineering Today] (published by Prof. H. J. Warneke), a description of so-called sliding grinding is given in volume 14, Entgraten, Theorie, Verfahren, Anlagen [Deburring, Theory, Methods, Apparatus] by F. Schäfer on pages 93 to 98. A multiplicity of blanks located in a rotationally driven drum slide against one another and against added abrasive media during the rotary movement of the drum. The manner in which they slide against one another is dependent on the speed of rotation. At low speeds, sliding against one another takes place. As from a certain speed, the sliding zone breaks down; workpieces and abrasive media described there strike one another. This and the sliding against one another effects a surface-removing effect.

In the case of the method of the type in question, blanks which have at least two portions of different cross section aligned axially, one after the other, are treated. In a chemical electroplating bath, particles of a hard material are embedded into a metallic delimiting layer on the surface of a first portion which has indentations or the like, the particles projecting from the surface of the layer. The exposed surfaces of a second portion remain to the greatest extent free from hard material particles. The exposed surfaces may be the circumferential surfaces of a cylinder. The base of the cylinder may be a circular surface, an oval surface or a hexagonal surface. The base of the cross section of the portion having the indentations may have a serrated or star-shaped contour. The tooth or star flanks of this portion are to be provided with an embedding of hard material particles. The application of hard material particles to reduce the wearing of workpieces or to increase friction is known in particular in the case of heavy-duty machine parts and also in the case of tools. It is also known, however, to reduce by such measures the susceptibility to wear of portions of other types of metallic objects that are subject to friction or pressure. In the case of known methods, regions of the workpieces that are not to be coated must be covered by means of lacquer or the like. For example, laid-open patent application 29 20 593 shows a method by which particles are introduced into a metal surface by means of locally supplying current. From patent specification 28 55 054, a method is known in which the stator blade of a turbine is coated with a layer of metal with incorporated foreign particles. In this case, only the portions of the blade covered by a clamping device remain uncoated.

SUMMARY OF THE INVENTION

An object of the invention is to find a method of the type in question which, while avoiding covering parts of the workpiece, provides coatings, in particular diamond coatings, which gradually vary in size over the subregions of the workpiece.

This is achieved by a multiplicity of blanks being freely rolled around in a rotating drum in a dispersion of hard material particles kept suspended in the electroplating liquid in such a way that hard material particles adhering to the exposed surfaces can be removed again by the blanks rubbing against one another.

The correspondingly pretreated, degreased, rinsed and pickled blanks are filled in large numbers into the drum, in the walls of which openings are formed. These are smaller than the diameter of the blanks, so that the latter remain as intended in the drum. The filled drum is lowered into the electroplating medium and rotates within the same. Within the electroplating medium, the drum performs rotary movements, taking the pretreated blanks with it. The electroplating medium passes through the openings in the drum into the latter and comes into contact with the surface of the blanks. In regard to the electroplating medium, there is in question a dispersion that is kept in motion of hard material particles and a metallic component. Both the metallic component and the hard material particles are deposited on the surface of the blanks. The motion of the drum has the effect here that the hard material particles adhering to the exposed surfaces of the blanks are removed again by the mutual rubbing of the blanks against one another. On the other hand, the hard material particles remain in the region of the grooves which are flanked by the working surfaces. In other words, no abrasion takes place in this region, so that the desired frictional particle density is achieved there. What is generally regarded as disadvantageous in sliding grinding, namely that unworked pockets are present on the workpieces, is used as an advantage in the method according to the invention. In order that the hard material particles occur in the same density in the electroplating medium and are not deposited, the agitating mechanism is provided. This keeps the hard material particles in suspension in the electroplating medium. Furthermore, the drum is formed to be of cylindrical shape and is driven about its horizontally disposed axis of rotation. For example, the drum may have a cross-sectionally polygonal contour, by which during rotation of the drum, there is established good rolling around of the blanks accommodated in the drum. It is possible in this case for the drum to be filled with blanks approximately up to half-full, so that a large number of blanks can be coated during one coating process. It is of advantage here that the rotating drum is fully submerged in the electroplating medium. The electroplating liquid concerned has a nickel component, which is precipitated in the form of metallic nickel on the surface of the blanks without electrical voltage. The hard metal particles kept in suspension in the electroplating liquid during this process are preferably diamond grains, in particular of an order of magnitude of from 10 to 30 $\mu$m. This means that the diamond grains partially protrude in certain regions out of the layer located on the working surfaces and represent for example a nonslip layer or an abrasion-protected layer. The layer of nickel accordingly represents the delimiting layer for these diamond grains. The larger the particle size of the diamond grains, the more the "cam-out effect" decreases. For optimum coating of the working surfaces, it is of advantage for the movement of the drum to take place with intermittent breaks. After a phase of rotational movement of the drum of an appropriately long duration, there is a suitably matching break, in which the adherence of the hard metal particles within the electroplating medium takes place. Before coating, the blanks fed to the drum are degreased, pickled and treated in a nucleating bath (nickel strike). The apparatus for carrying out the method is distinguished by the fact that the drum has a polygonal cross section with journals extending from the end walls of the drum, one of which journals can be brought into coupling connection with the rotary drive of the drum. For removal of the drum from the electroplating bath, the coupling connection between journal and rotary drive is released, while the coupling connection between these parts is established when the drum is inserted. The openings for the electroplating medium to pass through are provided in the walls of the drum. This electroplating medium is situated in the tank, which is provided with an agitating mechanism in order to keep the hard material particles in suspension in the electroplating medium. The workpieces produced by the method are created such that the exposed surfaces are also coated with hard substance particles with a surface density which is at least ten times less than that in the region lying in the grooves. It is thus ensured that the main hard material particle coating takes place only in the intended region, that is to say on the surfaces flanking the grooves. In a certain respect, the removal of material by sliding grinding also affects a subregion of the grooves, however, in such a way that the surface density of hard material particles increases towards the groove base. The effective surfaces are not disadvantaged by this, it is rather the region more remote from here that is disadvantaged. A saving in hard material particles is achieved by the surface density of hard material particles being at least ten times less at the end faces of the land than that in the region of the groove base. The elongated blanks may be of a variety of shapes. For example, they may be the size of a pencil. The portion having the indentations or the like may have a star-shaped or serrated cross-sectional contour. In the treatment of such blanks, essentially only the serrated or star-shaped portion is coated with the abrasion-resistant and/or abrasive surface. The exposed parts remain free from coating. If the method is applied to screwdriver inserts, the second portion, formed in particular as a profile of hexagonal cross section, remains to the greatest extent free from hard material particles, while the working portion having a cruciform profile receives coating at the flanks. It is also of advantage in this case that the method of production can be seen from the finished products on account of the gradually varying hard material particle density on the various portions. In the coating of such blanks, the slight coating of the end faces of the land and the increasing hard substance particle density towards the base of the indentations act favourably on the "cam-out effect". Such diamond-coated blanks may be gold-coated for passivation of the surface.

BRIEF DESCRIPTION OF THE DRAWINGS

The method, the apparatus and the product produced by the method of the apparatus are explained below on the basis of an exemplary embodiment illustrated in drawings, in which:

FIG. 1 shows in enlarged representation a view of a screwdriver insert with a cross-slot type working end, FIG. 2 shows the section along the line II—II in FIG. 1.

DETAILED DESCRIPTION OF THE PREFERRED EMBODIMENT

Figure 3:
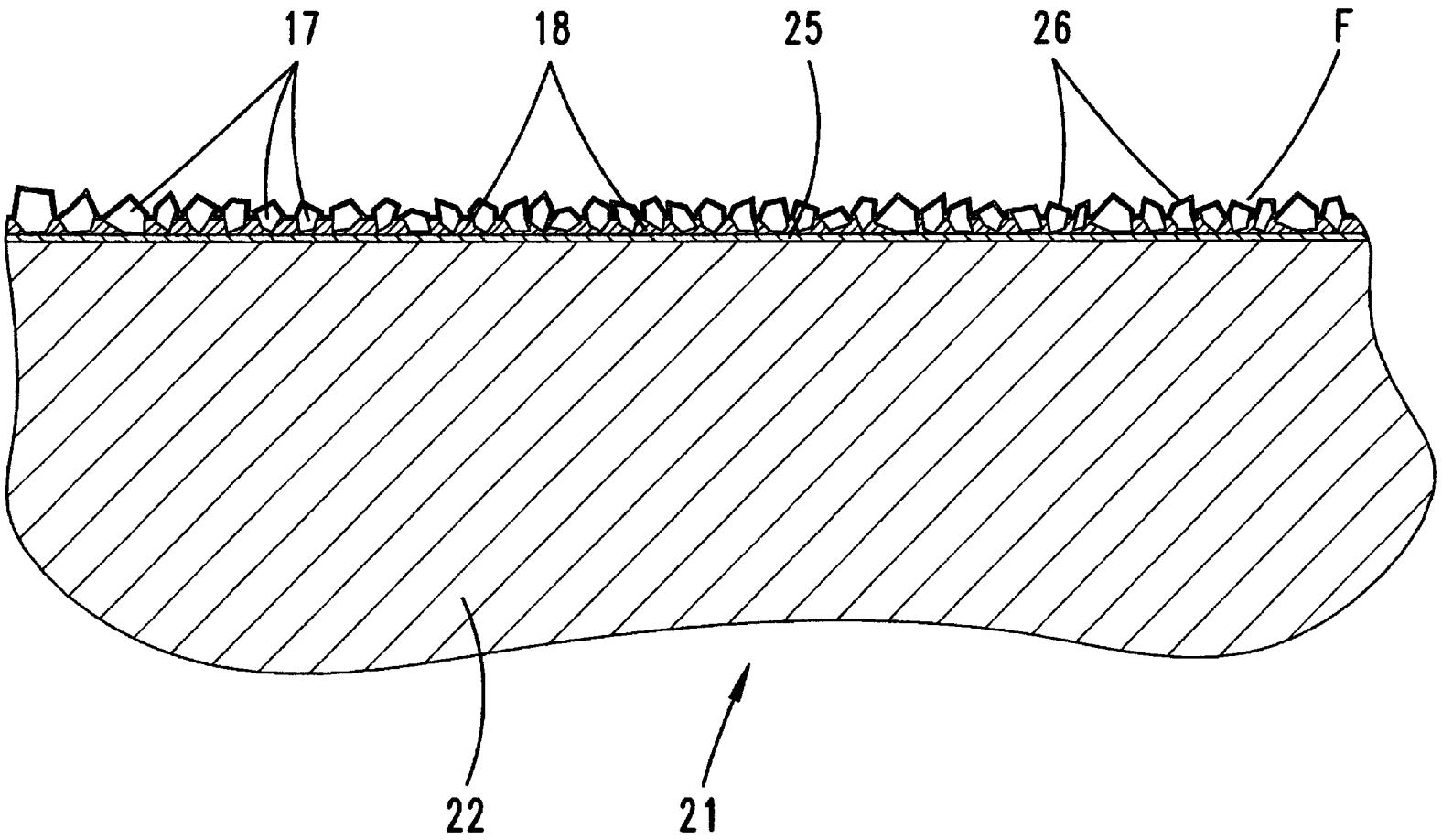
FIG. 3 shows in extreme enlargement a cross-section of the working end in the region of a working surface.
Figure 5:
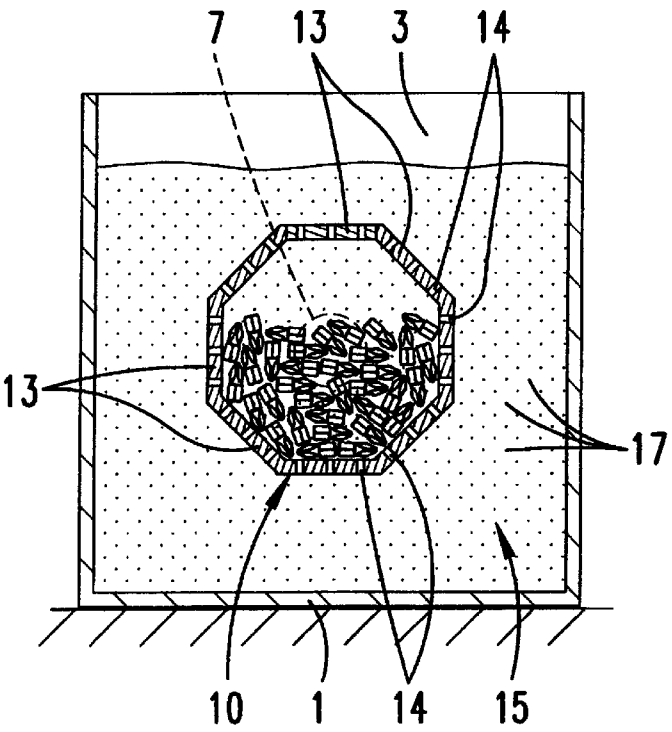
FIG. 5 shows a cross section through the apparatus.
Figure 4:
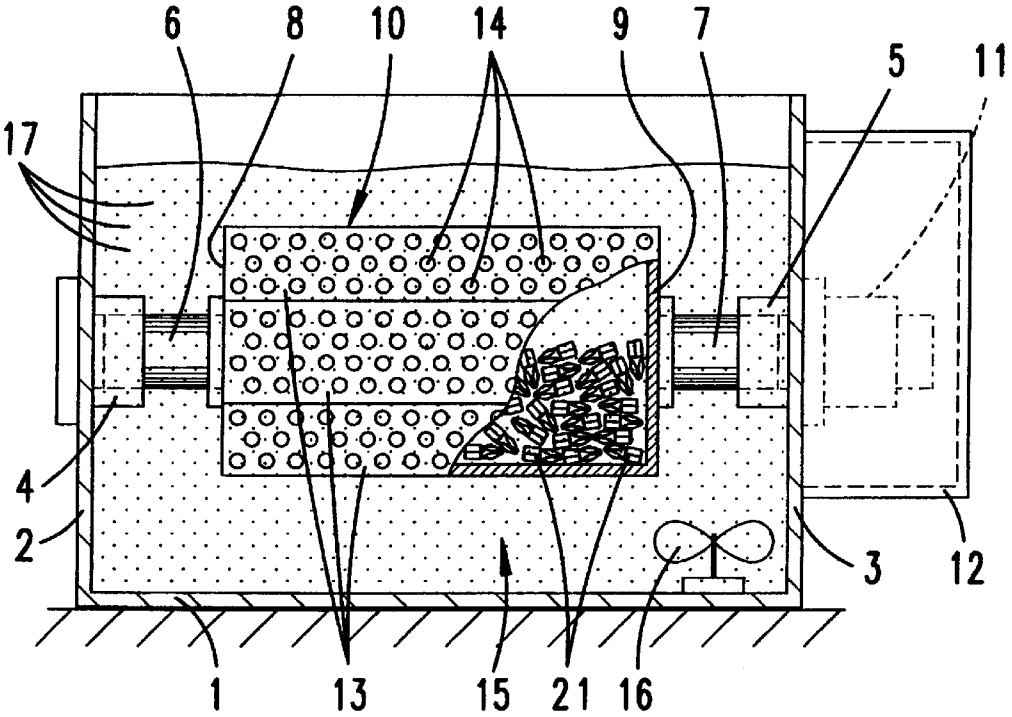
FIG. 4 shows in schematic representation a longitudinal section through the apparatus for carrying out the method.

The apparatus for carrying out the method according to the invention has a tank 1 with an upwardly facing tank opening. The tank end walls 2, 3 carry bearing shells 4 and 5, respectively, which project into the tank interior. They serve for receiving journals 6 and 7, respectively, which extend in coaxial alignment from the drum end walls 8, 9 of a drum 10. Insertion of the drum 10 takes place from above, the journals 6, 7 being received by the bearing shells 4 and 5, respectively. A securing means (not illustrated) has the effect that the journals 6, 7 remain in the bearing shells 4 and 5, respectively.

The drum 10 for its part can be set in rotation by means of a rotary drive 11, the journal 7 facing the rotary drive 11 being capable of being brought into coupling connection with the rotary drive 11 for this purpose. The latter is enclosed by a shroud 12, fitted onto the tank end wall 3. The cylindrically shaped drum 10 is consequently driven about its horizontal-disposed axis of rotation. The drum 10 itself has a polygonal cross section. In the case of the exemplary employment, an octagonal form is chosen. The drum walls 13 have openings 14 for the passing through of an electroplating medium 15, which passes through the openings 14 in the drum 10. Furthermore, the drum 10 is also fully submerged in the electroplating medium 15. As far as the latter is concerned, it is a dispersion that is kept in motion. Serving this purpose is an agitating mechanism 16, which is accommodated within the tank 1 and is schematically illustrated.

The coating of a screwdriver bit is given by way of example for the application of the method.

In the apparatus described above, particles 17 of a hard material are applied in a metallic delimiting layer 18 to the working surface F of a working end 20, provided with grooves 19 and exposed surfaces, of a screwdriver insert 21 in such a way that the hard material particles 17 protrude in certain regions from the surface of the layer, cf. in this respect FIG. 3. The working end 20 is shaped in a cruciform manner in cross section and serves for engagement with cross slotted screws. The grooves 19 are flanked by land areas 22, which rise in frustoconical form in the direction of the shank 23. A polygonal portion 24 is connected to the shank 23, portion 24 being hexagonally shaped in cross section.

Before applying the hard material particles 17 in the metallic delimiting layer 18, the blanks concerned are subjected to a pretreatment. This takes place in the drum 10 removed from the tank 1. The blanks are introduced into the said drum until the drum 10, which can be closed by a cover, is approximately half-filled with blanks. The filling level of the drum 10 may in this regard vary between one-third to two-thirds of the drum volume. Degreasing with an alkaline solution, electrolytic degreasing and rinsing of the blanks then take place in special baths. Then, the blanks are pickled, rinsed and subsequently treated in a nucleating bath (nickel strike). As a result, the blank receives a nickel strike layer 25, illustrated in FIG. 3. Then, the filled drum 10 is subjected to cascade rinsing with fresh water. Once this has happened, the inserting of the drum 10 with the correspondingly pretreated blanks into the tank 1 takes place, with establishment of the coupling connection of the journal 7 with the rotary drive 11. The L fully receiving the drum 10 is an electroplating liquid which has a nickel component. The hard material particles 17 are kept suspended in said L by means of the agitating mechanism 16. As far as the hard material particles 17 are concerned, they are diamond grains with an order of magnitude of from 10 to 30 $\mu$m. After introducing the drum 10 into the tank 1, the drum 10 rotates with intermittent breaks. This means that at intervals following a phase of rotational movement of the drum, there is a break in which the nickel component of the electroplating liquid is precipitated with the hard material particles 17 in the form of metallic nickel (delimiting layer 18) on the surface of the blanks. If the rotation of the drum 10 is then continued after the break, the motion of the drum and the blanks rolling around thereby cause the hard material particles 17 adhering to the exposed surfaces of the said blanks to be removed again by mutually rubbing against one another, the grooves 19, and consequently the working surfaces F located there, being largely excluded from this removal of particles. In the course of one cycle, the coating thickness on the working surfaces F then increases. It can be seen from FIG. 1 that the surface density of hard material particles 17 in the case of the screwdriver insert 21 on which treatment has been completed increase towards the groove base 19'. The cause of this is that in the increasing groove cross section, neighbouring blanks can bring about a slight rubbing effect during the rolling around in the drum 10. This removal of material in the grooves 19 extends, however, in the zone which is of no significance for the screw insert. In the region of the working end 20, the working surfaces F concerned, coming into surface-area contact with the screw, are present with undiminished layer thickness.

FIG. 1 also reveals that the exposed surfaces of the fixed end (polygonal portion 24) are also coated with hard material particles. The surface area density present there is at least ten times less than that in the region of the grooves 19 of the working end 20. This low surface area density of hard material particles in the region of the fixed end does not have a disadvantageous effect on the fitting of the screwdriver insert into a corresponding receiver. In the inserted position in the receiver, the slight coating with hard material particles even leads to an improved seating of the screwdriver insert in the receiver. FIG. 1 further illustrates that the surface area density of hard material particles 17 at the land end faces 22' is also less than that in the region of the base of the groove. At the land end faces, the surface area density of the hard material particles 17 is at least ten times less than that in the region of the base 19' of the groove of the working end 20. This low surface area density of hard material particles 17 at the land end faces 22' even improves the seating of the working end 20 in the slot of a screw to be turned with it.

After the appropriate residence time of the blanks in the electroplating medium 15, achieving the coating of the working end 20, the drum is to be lifted out of the tank 1. Rinsing with fresh water then follows. Subsequently, the diamond-coated blanks may be gold-coated in a hard bright gold bath for passivation of the surface. The gold coating is denoted in FIG. 3 by the numeral 26.

What is claimed is:

1. Method for coating a plurality of elongated metal blanks, wherein each of the blanks have at least two portions of different cross sections aligned axially one after another, wherein a first of said portions of each of the blanks has indentations and a second of said portions of each of the blanks has exposed surfaces, the method comprising the steps of in a chemical electroplating bath with a dispersion of hard material particles suspended in the bath forming an electroplating medium, electroplating a metallic delimiting layer onto the blanks, with the particles embedding into the delimiting layer and projecting therefrom while rolling the plurality of blanks freely around in a rotating drum in said dispersion such that the hard material particles embedding into the delimiting layer at the exposed surfaces of the blanks are removed by the blanks with the projecting particles rubbing against one another, wherein the exposed surfaces remain substantially free from the particles relative to the particles in the indentations, the indentations being less exposed to the rubbing blanks than said exposed surfaces.

2. Method according to claim 1, wherein the particles (17) are suspended in the electroplating medium (15) by means of an agitating mechanism (16).

3. Method according to claim 2, wherein the drum (10) is fully submerged in the electroplating medium (15).

4. Method according to claim 1, wherein the drum (10) is formed of cylindrical shape and is driven about a horizontal axis of rotation.

5. Method according to claim 1, wherein the drum (10) is filled with the blanks up to approximately one-half full.

6. Method according to claim 1, wherein the electroplating bath has a nickel component, said nickel component is precipitated in a form of metallic nickel on the surfaces of the blanks without electrical voltage.

7. Method according to claim 1, wherein the particles (17) are diamond grains.

8. Method according to claim 7, wherein the hard material particles (17) have an order of magnitude from 10 to 30 $\mu$m.

9. Method according to claim 1, wherein movement of the drum (10) takes place with intermittent breaks.

10. Method according to claim 1, wherein before electroplating, the blanks are degreased, pickled and treated in a nucleating bath.

11. Method according to claim 1, wherein the drum (10) has a polygonal cross section with journals (6, 7) extending from end walls of the drum, one of said journals (7) is capable of being brought into coupling connection with a rotary drive (11) of the drum (10).

12. Method according to claim 11, wherein side walls (13) of the drum (10) are provided with openings (14) for the electroplating medium (15) to pass through.

13. Method according to claim 11, wherein a tank (1) receiving the drum (10) is provided with an agitating mechanism (16).

14. Method according to claim 1, wherein the blanks are screwdriver inserts, the exposed surfaces being formed by polygonal surfaces of a hexagonal profile and the indentations being formed by clearances of a cruciform profile.

15. Method according to claim 1, wherein a hard material density on flanks of the indentations increases toward a base of the indentations.

16. Method for coating a plurality of elongated metal blanks, wherein each of the blanks has indentations and exposed surfaces, comprising the steps of: immersing the blanks in a chemical electroplating bath having a metallic material therein, and a suspension of hard material particles forming an electroplating medium; electroplatingly depositing the particles and the metallic material onto the blanks to form a layer on the blanks at the indentations and exposed surfaces with said particles embedded in the metallic material and projecting therefrom; rolling the blanks in a rotating drum disposed in the electroplating bath such that the blanks with the embedded projecting particles rub against one another, and remove particles from exposed surfaces of the blanks, by performing the depositing step and rolling step simultaneously.

17. Method according to claim 16, wherein the blanks with the embedded projecting particles rub against one another are elements having abrasive surfaces and are produces by the depositing step, and in the simultaneous rolling step abrade themselves again.

18. Method according to claim 16, wherein the particles (17) are suspended in the electroplating medium (15) by means of an agitating mechanism (16).

19. Method according to claim 16, wherein the bath has a nickel component, said nickel component is precipitated in a form of metallic nickel on surfaces of the blanks without electrical voltage.

20. Method according to claim 16, wherein the particles (17) are diamond grains.

21. Method according to claim 16, wherein the drum (10) has a polygonal cross section with journals (6, 7) extending from end walls of the drum, one of said journals (7) is capable of being brought into coupling connection with a rotary drive (11) of the drum (10).

22. Method according to claim 21, wherein side walls (13) of the drum (10) are provided with openings (14) for the electroplating medium (15) to pass through.

23. Method according to claim 16, wherein a hard material density on flanks of the indentations increases toward a base of the indentations.

* * * * *